US009746003B2

(12) United States Patent
Frank et al.

(10) Patent No.: US 9,746,003 B2
(45) Date of Patent: Aug. 29, 2017

(54) MOTOR SUSPENSION FOR FANS, PREFERABLY AXIAL-FLOW FANS, AS WELL AS METHOD FOR MANUFACTURING AN AIR GRILLE OF SUCH A MOTOR SUSPENSION

(75) Inventors: Christian Frank, Schwäbisch Hall (DE); Patrick Neumaier, Bretzfeld (DE); Christian Schönbein, Künzelsau (DE)

(73) Assignee: Ziehl-Abegg AG, Künzelsau (DE)

( * ) Notice: Subject to any disclaimer, the term of this patent is extended or adjusted under 35 U.S.C. 154(b) by 543 days.

(21) Appl. No.: 13/571,950

(22) Filed: Aug. 10, 2012

(65) Prior Publication Data

US 2013/0045085 A1 Feb. 21, 2013

(30) Foreign Application Priority Data

Aug. 18, 2011 (DE) ..... 10 2011 110 961
Dec. 8, 2011 (DE) ..... 10 2011 121 025

(51) Int. Cl.
*F04D 29/64* (2006.01)
*F04D 29/70* (2006.01)
*F04D 29/66* (2006.01)

(52) U.S. Cl.
CPC ..... *F04D 29/703* (2013.01); *F04D 29/668* (2013.01); *F04D 29/646* (2013.01); *Y10T 29/49826* (2015.01)

(58) Field of Classification Search
CPC ..... F04D 29/703; F04D 29/646
USPC ..... 417/423.9, 423.14; 415/121.2; 416/247 R
See application file for complete search history.

(56) References Cited

U.S. PATENT DOCUMENTS

| | | | | |
|---|---|---|---|---|
| 2,656,974 | A * | 10/1953 | Holstein | 416/244 R |
| 3,963,382 | A * | 6/1976 | Patton | F04D 29/646 415/121.2 |
| 4,761,115 | A | 8/1988 | Hopfensperger | |
| 6,017,191 | A | 1/2000 | Harmsen | |
| 6,036,444 | A * | 3/2000 | Barney et al. | 416/247 R |
| 6,454,537 | B1 * | 9/2002 | Perella et al. | 416/247 R |
| 6,503,060 | B1 | 1/2003 | Kamada et al. | |
| 6,585,489 | B2 * | 7/2003 | Perella et al. | 416/247 R |
| 7,104,753 | B2 * | 9/2006 | Eubank | F04D 29/703 415/121.2 |
| 2003/0049132 | A1 | 3/2003 | Perella et al. | |
| 2003/0091435 | A1 | 5/2003 | Horng et al. | |

(Continued)

FOREIGN PATENT DOCUMENTS

| | | |
|---|---|---|
| DE | 23 45 539 | 3/1975 |
| DE | 197 53 373 A1 | 6/1998 |

(Continued)

*Primary Examiner* — Peter J Bertheaud
(74) *Attorney, Agent, or Firm* — Gudrun E. Huckett

(57) ABSTRACT

A motor suspension for fans has an air grille with radially extending braces and grille rings that are positioned coaxially to each other and are connected to each other by the radially extending braces. For adapting the motor suspension to a vibration behavior of a fan, at least one of a feature selected from a number of the braces and a diameter of the braces is varied to effect a reduction of acoustic noises and/or natural resonances of the motor suspension. The number of the braces that are preferably made of metal is preferably unequal to the number of vanes of the fan.

15 Claims, 19 Drawing Sheets

(56) References Cited

U.S. PATENT DOCUMENTS

| | | | |
|---|---|---|---|
| 2004/0234374 | A1 | 11/2004 | Huber |
| 2005/0238481 | A1 | 10/2005 | Yamamoto et al. |
| 2009/0110542 | A1 | 4/2009 | Kim et al. |

FOREIGN PATENT DOCUMENTS

| | | | |
|---|---|---|---|
| DE | 101 11 397 | A1 | 9/2002 |
| DE | 10 2005 023 868 | B3 | 7/2006 |
| DE | 10 2009 025 025 | A1 | 12/2009 |
| JP | H06-280799 | A | 10/1994 |

* cited by examiner

MOTOR SUSPENSION FOR FANS, PREFERABLY AXIAL-FLOW FANS, AS WELL AS METHOD FOR MANUFACTURING AN AIR GRILLE OF SUCH A MOTOR SUSPENSION

BACKGROUND OF THE INVENTION

The invention concerns a motor suspension for fans, preferably axial-flow fans, with an air grille with radially extending braces that connect grille rings, positioned coaxially to each other, with each other as well as a method for producing an air grille of such a motor suspension.

Motor suspensions are known whose air grilles comprise grille rings that are coaxially positioned relative to each other and are connected by radially extending braces with each other (DE 10 2009 025 025 A, DE 23 45 539 A. DE 101 11 397 A, DE 197 53 373 A). The radial inner ends of the braces are embodied either as fastening elements for connection with the motor, or are connected to a fastening disc which is connected with the fan. The radial outer end of the braces has holding elements (DE 101 11 397 A) which serve for receiving connecting means to the fan. The air grilles have in axial section straight areas and the radial inner and outer areas extend in opposite directions at a slant and adjoin at an obtuse angle a straight middle area. Such air grilles can be produced only with complex methods because for each of these grille areas an individual welding device and thus also an individual welding process are required.

Because in the operation of the fan noises can occur, it is known to produce the radially extending braces of flat sections which are positioned according to an average swirl component at an angle to the longitudinal axis of the fan (DE 10 2009 025 025 A). It is also known to form the sections between the radial outer end and radial inner end of the support braces out of the plane of the flat section so that their edges connected with the grille rings are maintained as straight lines. However, this causes the production and the configuration of the air grille to be very complex.

For avoiding flow-caused noises it is further known (DE 197 53 373 A) to configure the air grille in the manner of kind of an air guide wheel with blade-like vanes that extend about a certain axial air guiding length and are essentially arranged approximately radially. The vanes are arranged in at least two concentric circular rows and the number of the vanes is larger in the outer circular row than in the neighboring inner circular row. Such an embodiment of an air grille is constructively very complex and this makes the production of the air grille more expensive.

Finally, it is also known (DE 101 11 397 A) to push comb-like damping means onto the coaxial grille rings.

The object of the invention is to configure the motor suspension of the aforementioned kind and the method of the aforementioned kind in such a way that in a constructively simple and inexpensive manner an optimum noise and vibration reduction is achieved during operation of the fan.

SUMMARY OF THE INVENTION

This object is solved for the motor suspension of the aforementioned kind in accordance with the invention and for the method of the aforementioned kind in accordance with the invention in that, for adapting the motor suspension to the vibration behavior of the fan, the number and/or the diameter of the braces is varied with regard to a reduction of the acoustic noises and/or the natural resonances of the motor suspension.

With the motor suspension according to the invention, the number and/or the diameter (cross-section) of the braces is varied for adjustment of the vibration behavior of the fan in regard to a reduction of the acoustic noises and/or the natural resonances of the motor suspension. By variation of the number of braces and/or the diameter of the braces it is possible therefore in an easy manner to match the motor suspension to the respective application in such a way that the acoustic noises occurring in operation are minimal and/or the occurrence of natural resonances of the motor suspension is prevented.

In one embodiment, the number of braces, preferably made of metal, is selected such for the reduction of the noises in operation of the fan that it is not equal to the number of vanes of the fan. In this way, the air grille can be matched optimally with respect to noise reduction to the employed fan, respectively.

This adaptation can be especially simply carried out when the braces at their radial outer end are fastened to an outer support ring. It is thereby easily possible to simply attach the desired number of braces to the air grille.

An inexpensive and simple embodiment results when the outer support ring has a cylindrical outer wall to which the radial outer ends of the braces are fastened.

Advantageously, the outer support ring is made of flat material. It is formed advantageously from a strip which is bent to a cylinder. In this manner, the outer support ring can be produced very simply in any necessary diameter.

The outer support ring can be made in accordance with another embodiment of a flat material which is positioned in a radial plane of the air grille. In this way, a simple manufacture of the outer support ring is ensured. On the flat outer support ring the ends of the braces can be simply fastened.

The outer support ring must not be formed from a flat material. It can be also formed from at least one, preferably, however, from several grille rings. With the grille rings as an outer support ring, a simple and inexpensive manufacture of the air grille and thus of the motor suspension is possible also. The grille rings forming the outer support ring can lie in a radial plane side by side at a spacing. However, it is also possible that grille rings with the same diameter are arranged above one another so that they form essentially a cylindrical outer support ring.

The radial outer ends of the braces are advantageously angled. Then the ends can be very simply fastened to the outer support ring.

A safe connection of the radial outer brace ends results when the radial outer ends of the braces do not project past the outer support ring. In an advantageous embodiment, the length of the brace ends is shorter than the axial height of the outer support ring. The brace ends can thus be attached with their whole length to the outer support ring.

Advantageously, the radial inner ends of the braces are fastened to an upright inner support ring. Then the braces connect the outer support ring with the inner support ring. By means of the inner support ring the air grille can be simply attached to the fan independent of its connection intervals. Because the outer support ring and the inner support ring extend circumferentially and the inner support ring is in addition upright, the braces can be attached at any suitable location of the air grille and connected with the outer support ring and the inner support ring.

The motor suspension is embodied advantageously such that, when using the outer support ring, the motor suspension can be embodied individually and independent of the connection intervals of the customer interface. By means of the customer interface the connection of the motor suspension or the outer support ring is realized at a wall ring which contains the nozzle for the fan. The customer interface can be formed, for example, by bores in the edge area of the nozzle of the wall ring through which screws or the like are pushed with which the outer support ring, placed on the nozzle, can be connected with the nozzle. In such a case, the screw connection of the outer support ring with the nozzle is realized in radial direction.

By the advantageous use of the inner support ring, the motor suspension can be embodied individually and independent of the connection intervals of the fan. In this case, the radial inner ends of the braces are fastened advantageously to the upright edge of the inner support ring, while the interface for connection to the fan is outside of this upright edge.

The motor suspension of another embodiment is characterized in that the air grille has an arched form in axial section. Thereby it is possible to weld the air grille in a single device in a single operation. The air grille and with it the motor suspension can thus be produced very inexpensively and simply.

Advantageously, the braces preferably made of metal are embodied in a convex arch shape across their length. The grille rings which are connected by these braces with each other form therefore an air grille with an arched contour which, seen in axial section, has no longer any straight areas but across its radial width has an arched extension.

Advantageously, some of the braces project in radial direction inward and/or outward past the grille rings.

The projecting ends of these braces are provided advantageously with connectors with which the air grille can be fastened, for example, to a wall ring and to the fan.

Some of the braces of the air grille can have a length which is smaller than the radius of the air grille. In this connection, these shorter braces can all have the same length but they can also have different lengths. By suitable selection of the length and/or the cross-section of these braces, the motor suspension can be matched to the vibration behavior of the fan in such a way that the acoustic noises appearing in operation are minimized and/or no natural resonances of the motor suspension will occur.

Since the longer braces serve for connecting the air grille, for example, to a wall ring and to the fan, they have advantageously a bigger cross-section than the short braces.

The method according to the invention is carried out such that, for the reduction of the acoustic noises and/or shifting of the natural resonances of the motor suspension, the number and/or the cross-section of the braces is varied with regard to the reduction of the acoustic noises and/or the shift of the natural resonances of the motor suspension. The motor suspension can thereby be matched very simply to the vibration behavior of the fan.

It is thereby also possible, for example, to select the number of the braces in such a way that it is unequal to the number of the vanes of the fan. When the fan has, for example, four vanes, the air grille has a number of braces deviating from this number. According to size and/or installation site of the fan, the optimum number of braces can be very simply determined. In this manner not only the acoustics, above all the rotary sound of the fan, can be reduced, but also a possible vibrational resonance frequency of the motor suspension can be counteracted. With the selected number of the braces, the possibility is provided to match the components of the motor suspension according to the invention relative to each other in such a way that the noises and/or the natural resonances of the motor suspension are minimized.

The number of the braces must not mandatorily be unequal to the number of the vanes of the fan. It is decisive instead that the number of the braces and/or their diameter is selected such that the aimed at and described adaptation of the motor suspension is matched to the vibration behavior of the fan.

An easy method is provided when the radial outer ends of the braces are fastened to an outer support ring. The outer support ring enables the individual variation of the number of the braces, in particular independent of the connection intervals of the customer interface.

An easy and inexpensive production is possible when the radial outer ends of the braces are fastened to the outside of the outer support ring.

Other features of the invention are apparent from the further claims, the description and the drawings.

BRIEF DESCRIPTION OF THE DRAWINGS

The invention will be explained in more detail with the aid of some embodiments shown in the drawings. It is shown in.

DESCRIPTION OF THE PREFERRED EMBODIMENTS

Figure 2:
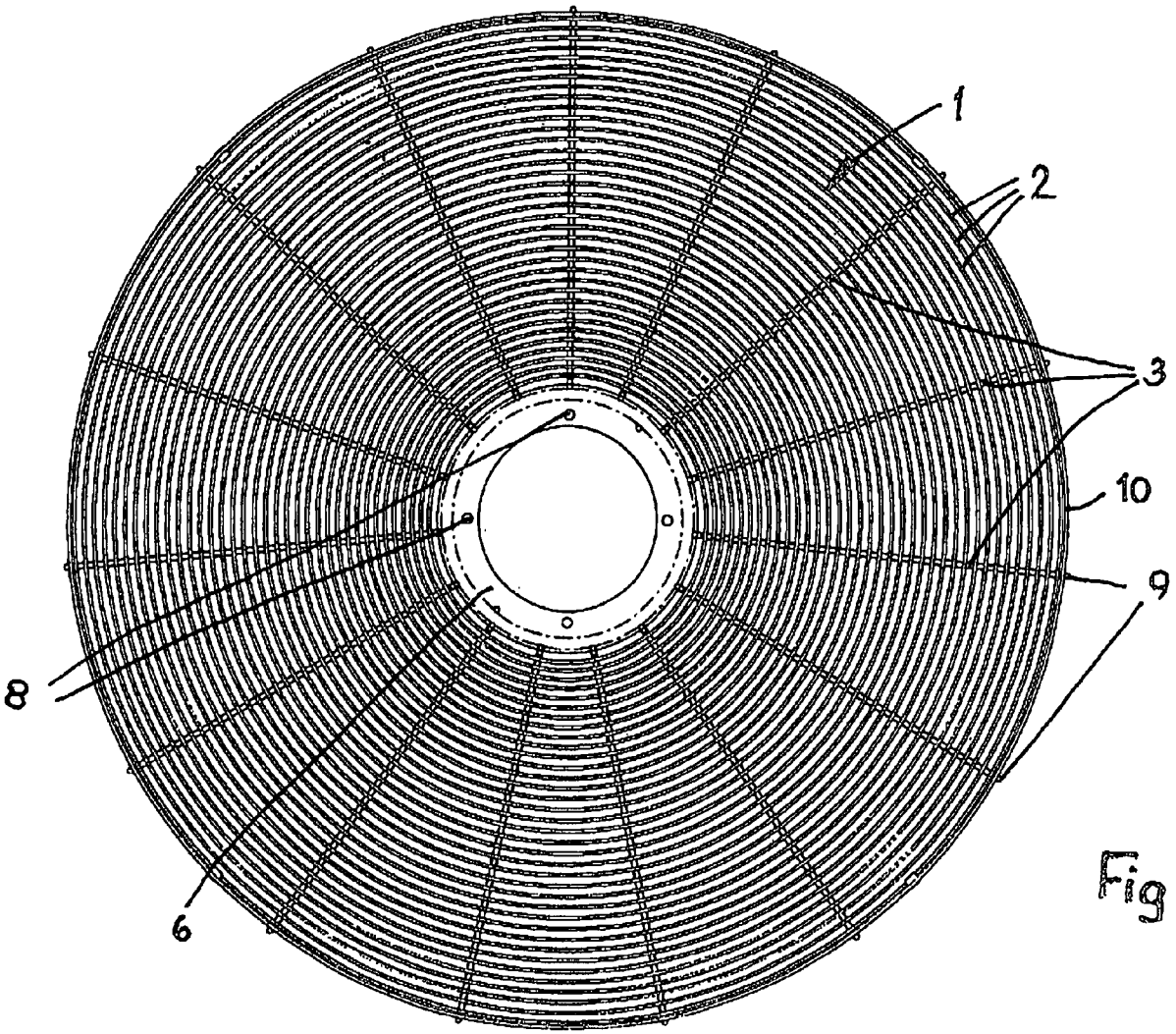
FIG. 2 a plan view of the motor suspension according to FIG. 1.

The motor suspension is provided for a fan 11 (FIG. 4), preferably an axial-flow fan, and has an air grille 1 which comprises grille rings 2 that extend coaxially to each other. They have advantageously the same distance relative of each other, viewed in plan view according to FIG. 2. The grille rings 2 have advantageously a circular cross-section (FIG. 3) and are advantageously comprised of metal. Depending on the application, the grille rings 2 may also have a cross-section that deviates from a circular shape.

In the shown preferred embodiment, all grille rings 2 of the air grille 1 have the same cross-sectional area. However, it is also possible that the individual grille rings have a different cross-section, depending on the position within the air grille 1.

The grille rings 2 are connected to each other by radially extending braces 3. They are made also advantageously of metal. They can also be made of wires with circular cross-section but can also be embodied as profiled braces. The course of the braces 3 across their length determines the shape of the air grille 1. The braces 3 are bent across their length in a convex arch shape so that the air grille 1 has an arched form. The braces 3 can be uniformly bent across their length. Nevertheless, it is advantageous when the braces 3 have a smaller radius of curvature in the radial outer area than in the radial inner area of the air grille 1. The air grille slopes therefore in the radial inner area more strongly than in the radial outer area (FIGS. 1 and 3).

Figure 1:
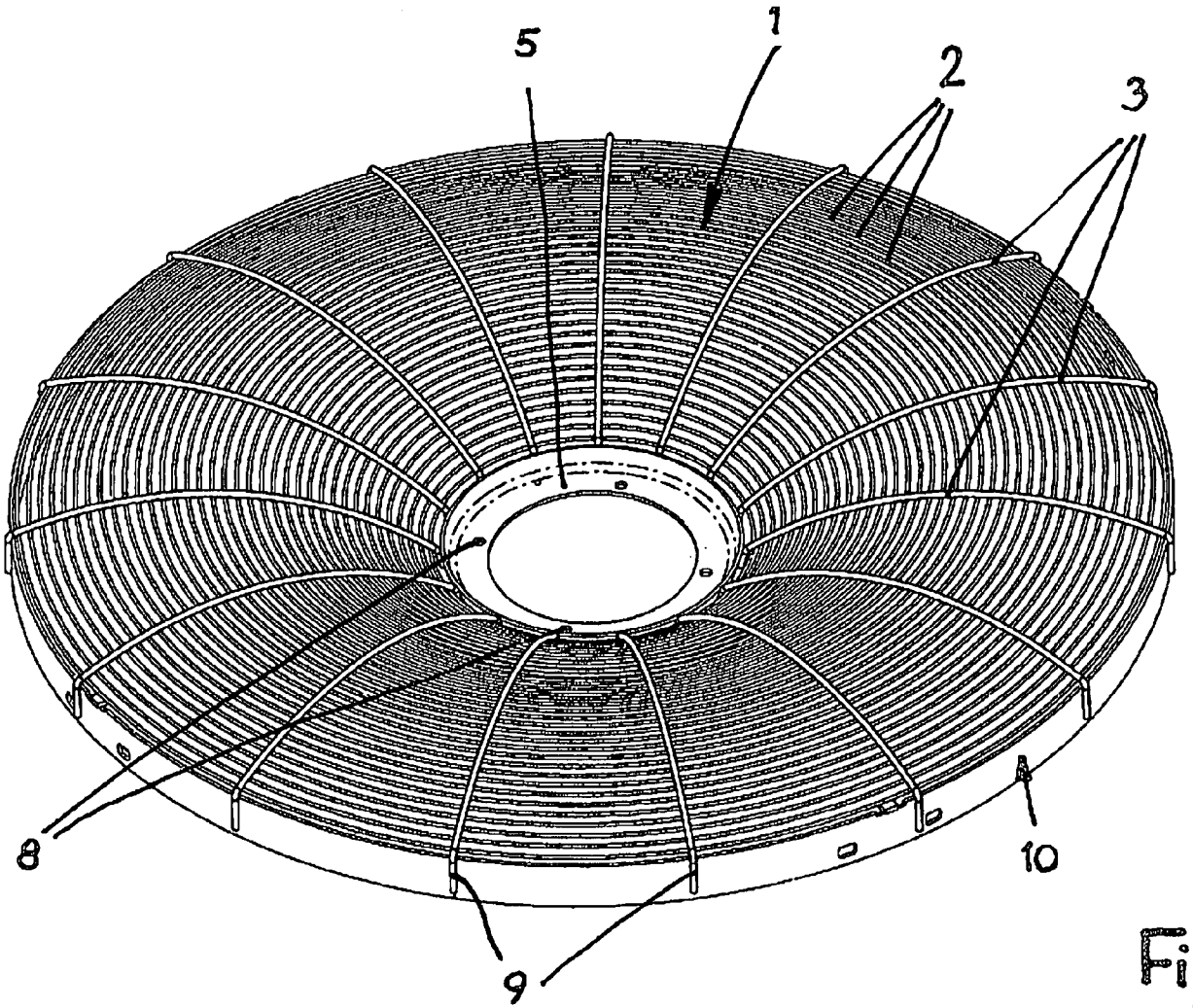
FIG. 1 in perspective illustration a motor suspension according to the invention.
Figure 3:
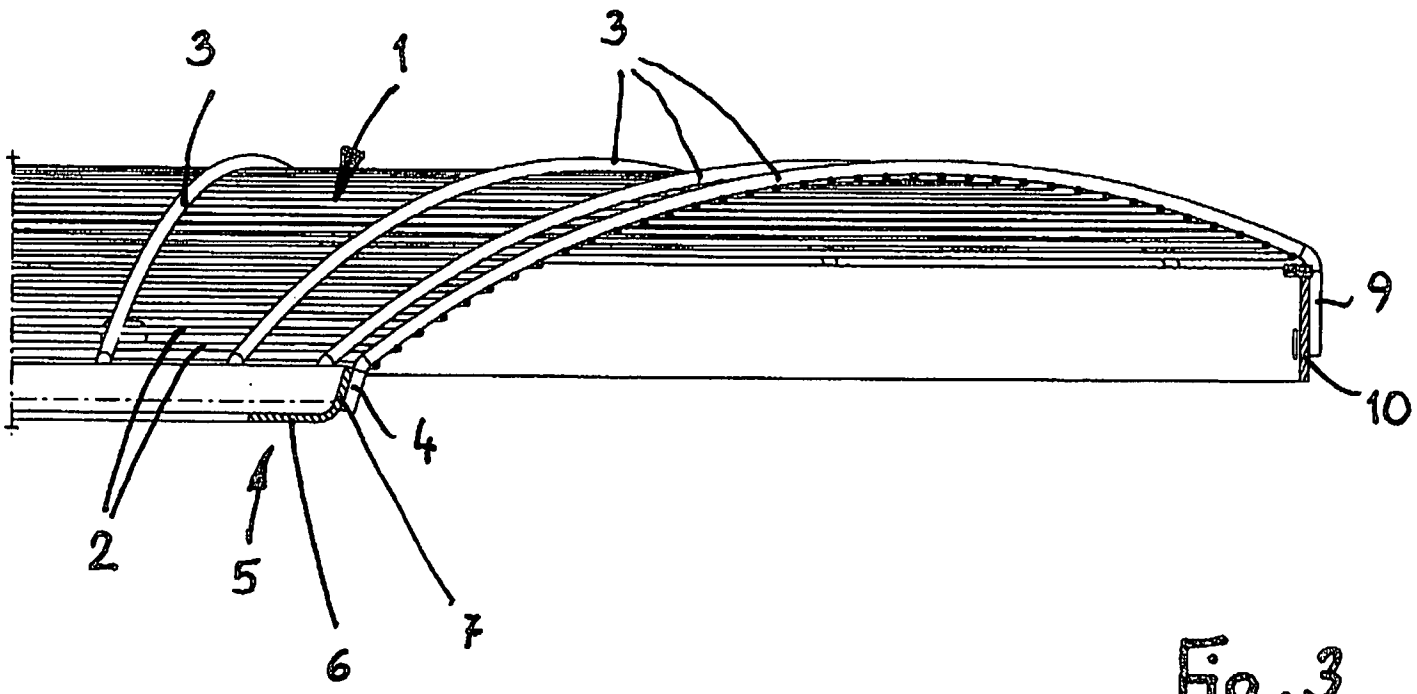
FIG. 3 an enlarged illustration of an axial section of the motor suspension according to the invention, FIG. 4 in perspective illustration the motor suspension according to FIGS. 1 to 3 connected with a fan, FIG. 5 in perspective illustration a second embodiment of a motor suspension according to the invention, FIG. 6 in perspective illustration the motor suspension according to FIG. 5 which is fastened to a wall ring, FIG. 7 in perspective illustration a third embodiment of a motor suspension according to the invention.
Figure 4:
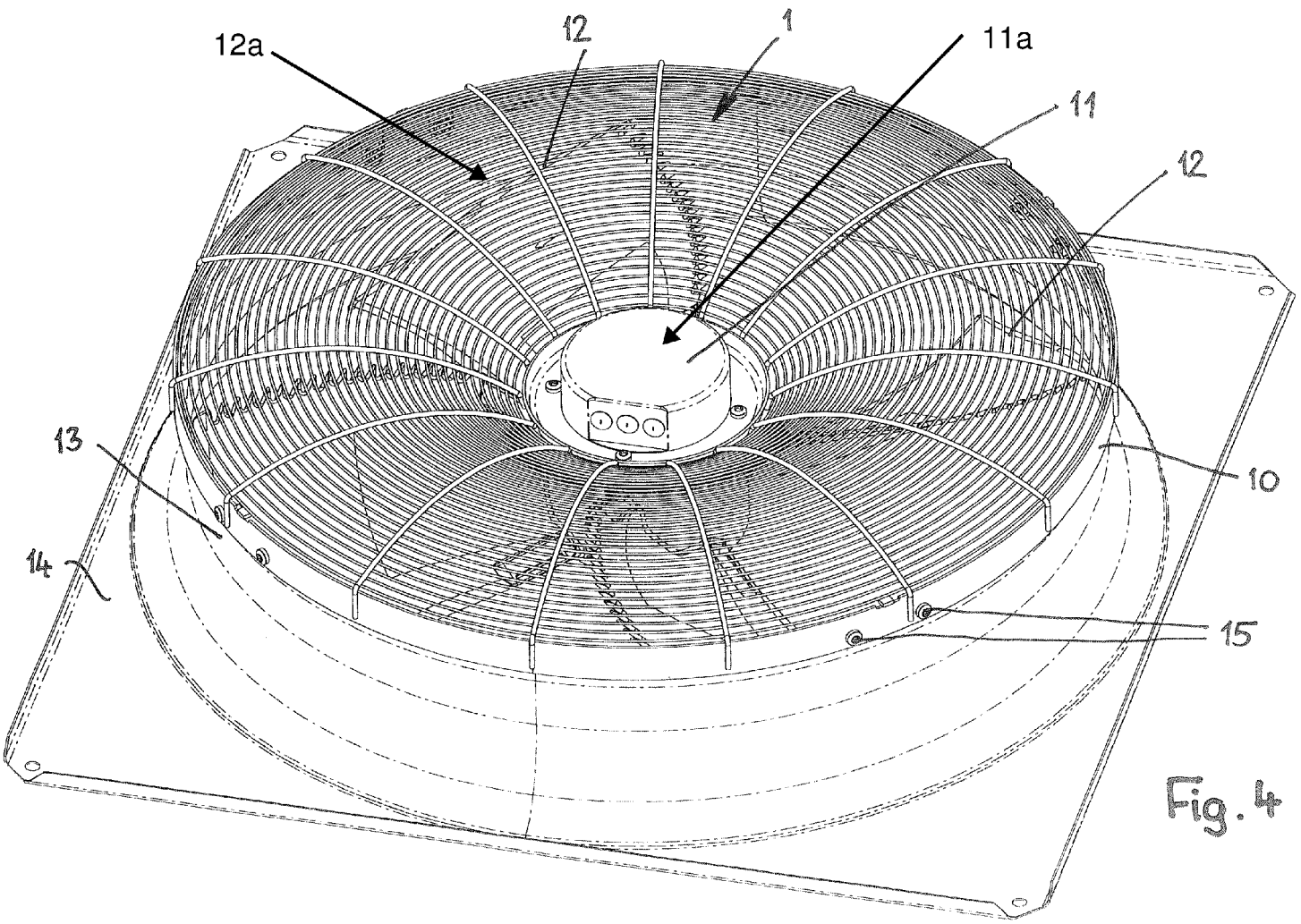

As shown in FIGS. 1 and 3, the braces 3 are fastened on the outside of the grille rings 2, i.e., on the side of the grille rings facing away from the fan. When the braces and the grille rings are made out of metal, they are welded to each other at the crossing points.

The braces 3 impart a high stability and strength to the air grille 1.

The radial inner ends 4 (FIG. 3) of the braces 3 are angled in the direction of the fan 11 and are fastened to an inner support ring 5. It has a flat annular part 6 that is positioned in a radial plane of the air grille 1 and a rim 7 that is oriented at a slant upwardly. The brace ends 4 are fastened to the outside of the rim 7 of the inner support ring. The annular part 6 comprises openings 8 that are distributed about its circumference. The fan 11 is fastened to the ring part 6 of the inner support ring 5 in a manner known in the art.

The radial outer ends 9 of the braces 3 are fastened to the outside of an outer support ring 10. It is coaxial to the axis of the air grille 11. As shown in FIG. 3, the ring part 6 is positioned in the direction of the fan 11 axially displaced to the outer support ring 10 which, viewed in axial direction, has a larger spacing from the fan 11 than the ring part 6 of the inner support ring 5. The inner support ring 5 and the outer support ring 10 are made advantageously of metal. The braces 3, when they are made of metal as is preferable, can be fastened simply by a welding process.

In order to reduce the acoustics, in particular the rotary sound of the fan 11, a grille concept with variable and/or asymmetrical number of the braces 3 is used. Thus, the overall system of motor suspension and fan 11 can be easily and inexpensively adjusted out of tune, for example, by change of the number of the braces 3 and/or by change of the brace cross-section, in such a way that the vibrational values are low; this will be described below in more detail. For example, the number of the braces 3 can be selected unequal to the number of the vanes 12 of the fan 11, independent of the interfaces relative to the outer support ring 10 and the inner support ring 5. To be able to vary simply the number of the braces 3 as a function of the number of the fan vanes 12 of the employed fan 11, the outer support ring 10 serves for connecting the braces 3 with their radial outer end 9 which is angled such that it can be fastened flat against the outside of the outer support ring 10. The outer support ring 10 is made preferably of a flat material which is bent preferably to an upright ring. The different number of braces 3 can be simply fastened to the outer support ring 10 so that the motor suspension can be matched in an easy manner and independent of the interfaces to the outer and inner support rings to the employed fan 11 and its number of vanes in order to minimize the noise development.

The number of the braces 3 can be selected additionally in such a way that a possible vibrational resonance frequency of the motor suspension is avoided.

Based on the described embodiment, there is the possibility to match the components of the motor suspension, that is the air grille 1 with the braces 3 and the outer support ring 10, such to each other that not only the rotary sound is reduced or even prevented but also the occurrence of vibrations of the motor suspensions a result of resonances is prevented.

Figure 19:
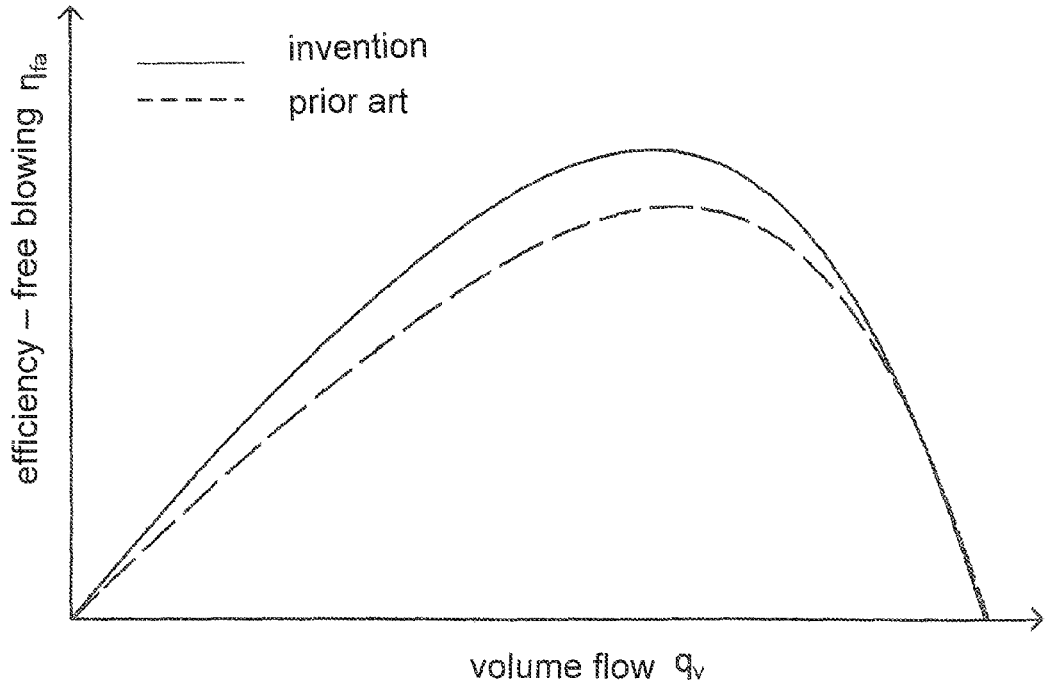

With the arched air grille 1 the efficiency of the motor is also improved. FIG. 19 shows the course of the efficiency as a function of the speed of the fan or of the volume stream $q_v$. The solid line applies to the arched air grille and the dashed line to a conventional air grille which is comprised of grille areas that in axial section are flat and angularly positioned relative to each other. The motors with the arched air grilles have a higher efficiency than the conventional motors.

In order for the ends 9 of the braces 3 to be simply fastened to the outer support ring 10, at least its outer wall is a smooth cylinder surface. The brace ends 9 are shorter than the height of the outer support ring 10. It is basically possible to attach the brace ends 9 also with the help of connection means, like screws, bolts and the like, to the outer side of the outer support ring 10. Such a connection can be also provided in addition to a weld connection between the brace ends 9 and the outer support ring 10. Deviating from the shown embodiment, the length of the brace ends 9 can also be identical to the height or even greater than the height of the outer support ring 10. The brace ends 9 are fastened in any case to the outer support ring 10 such that they do not project, relative to the illustration according to FIG. 3, downward past the outer support ring 10.

The grille rings 2 have such a distance relative to each other that they do not hinder, or hinder only minimally, the passage of air. Moreover, the distance is selected such that users cannot reach through the air grille 1 with their hand and come into contact the fan wheel of the fan 11. The attachment of the outer support ring 10 can be realized radially or axially in any intervals, relative to the interface (nozzle). The attachment of the inner support ring 5 can be realized without consideration of the interface to the fan 11. This will be explained in the following in more detail.

The air grille 1 with the outer support ring 10 is placed onto the free edge of a nozzle 13 (FIG. 4) which projects from a plate-shaped wall ring 14. In the area of the nozzle 13 the fan wheel 12*a* with vanes 12 of the fan 11 provided with the motor 11*a* is arranged in a known manner. The outer support ring 10 is fastened with radially extending screws 15 to the free edge of the nozzle 13. The nozzle 13 constitutes the customer interface. The motor suspension can be embodied on account of the described embodiment individually and independent of the connection intervals of the customer interface. The angular distance of the screws 15 across the circumference of the outer support rings 10 is pre-defined by the customer. The braces 3 can be provided independent of this customer-defined distribution of the screws 15 in such a way that the noise development is minimized and a resonance location is avoided in the operational range of the motor suspension in a reliable way.

Since the radial outer ends 9 of the braces 3 are attached to the outer side of the outer support ring 10, the air grille 1 together with the outer support ring 10 can be placed perfectly onto the free edge of the nozzle 13.

Figure 5:
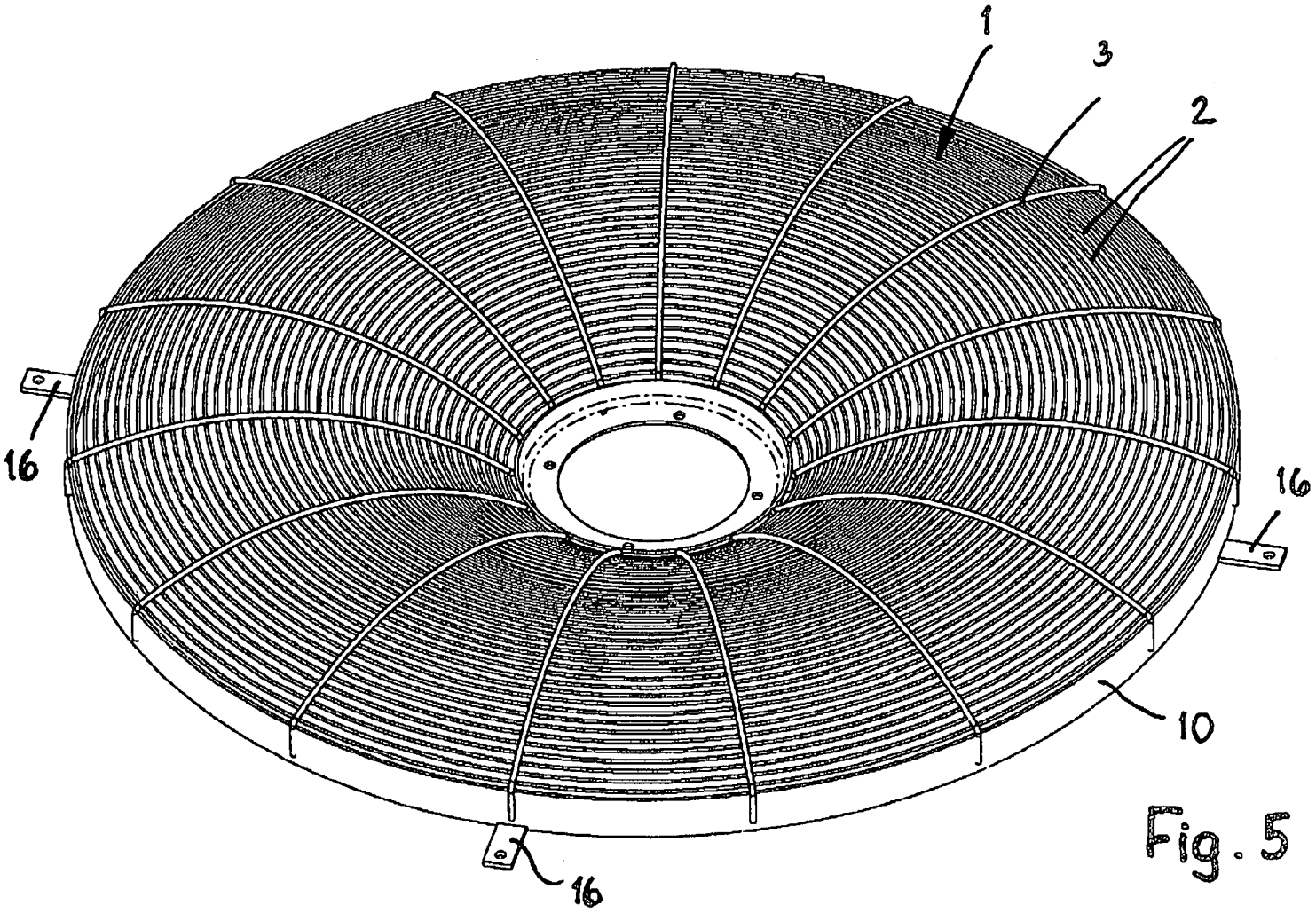
Figure 6:
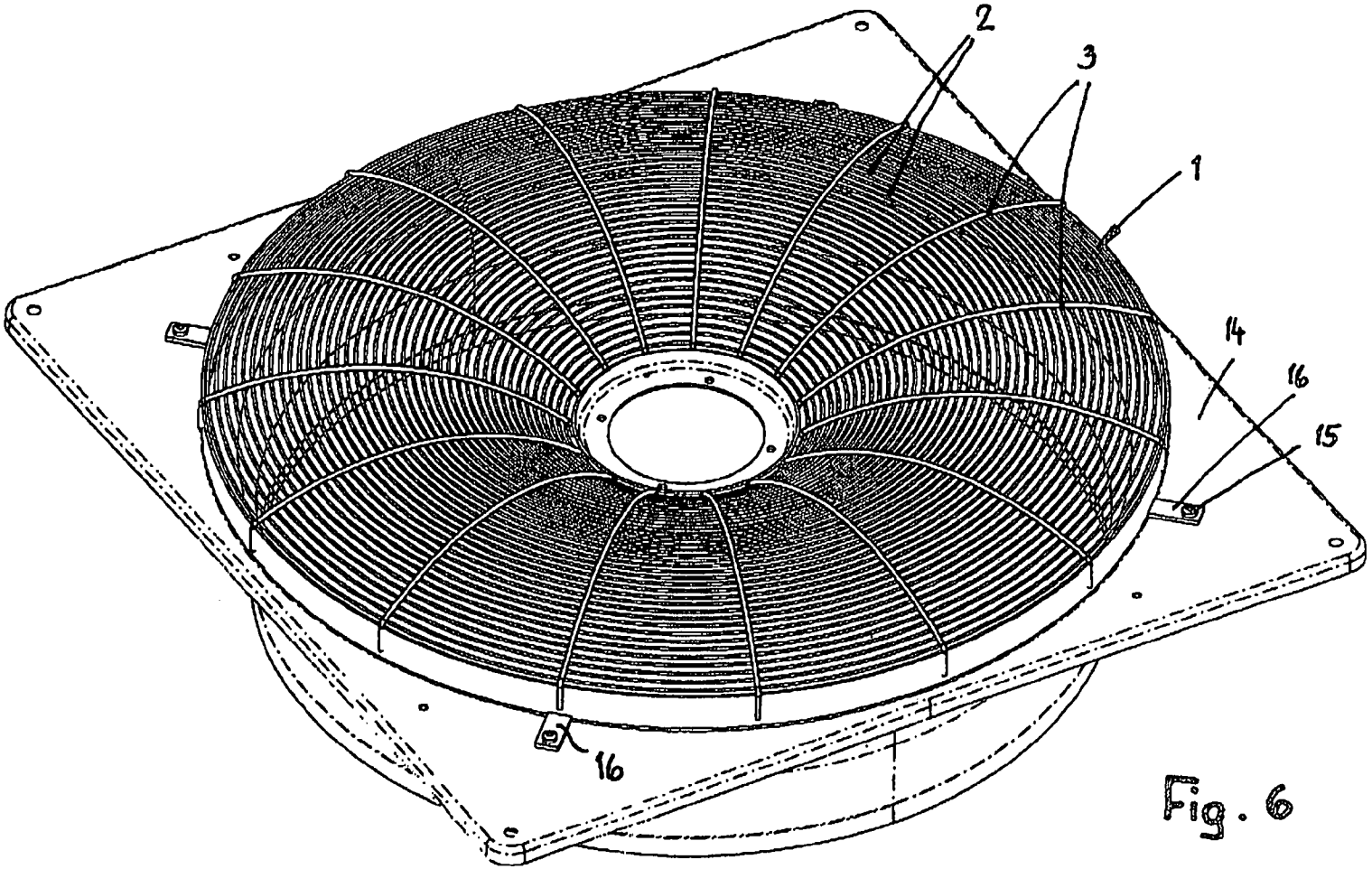

The embodiment according to FIG. 5 is substantially embodied like the embodiment according to the FIGS. 1 to 4. The difference merely consists in that the outer support ring 10 is screwed axially to the wall ring 14 (FIG. 6). For this purpose, on the outer support ring 10, distributed about the circumference, transversely extending tabs 16 are provided which are resting in the installed state on the wall ring 14 and are connected with it by screws 15. The tabs 16 that are radially extending away from the outer support ring 10 are positioned in the area below the free ends of the brace ends 9. Thereby, it is also possible to realize the motor suspension individually and independent of the division of the tabs 16 by means of such an axial connection of the motor suspension to the wall ring 14. Again, the number of braces 3 can therefore be selected without taking into consideration the embodiment of the customer's interface in such a way that the air grille 1 is optimized with respect to the noise reduction and the prevention of natural resonances of the motor suspension.

Also, the described embodiment of the inner support ring 5 enables to realize the motor suspension individually and independent of the connection intervals of the fan 11. The openings 8 in the ring part 6 of the inner support ring 5 can have any distribution which does not affect the connection of the radial inner ends 4 of the braces 3. These brace ends 4 are located in both described embodiments on the outer side of the upright edge 7 of the inner support ring 5.

Figure 7:
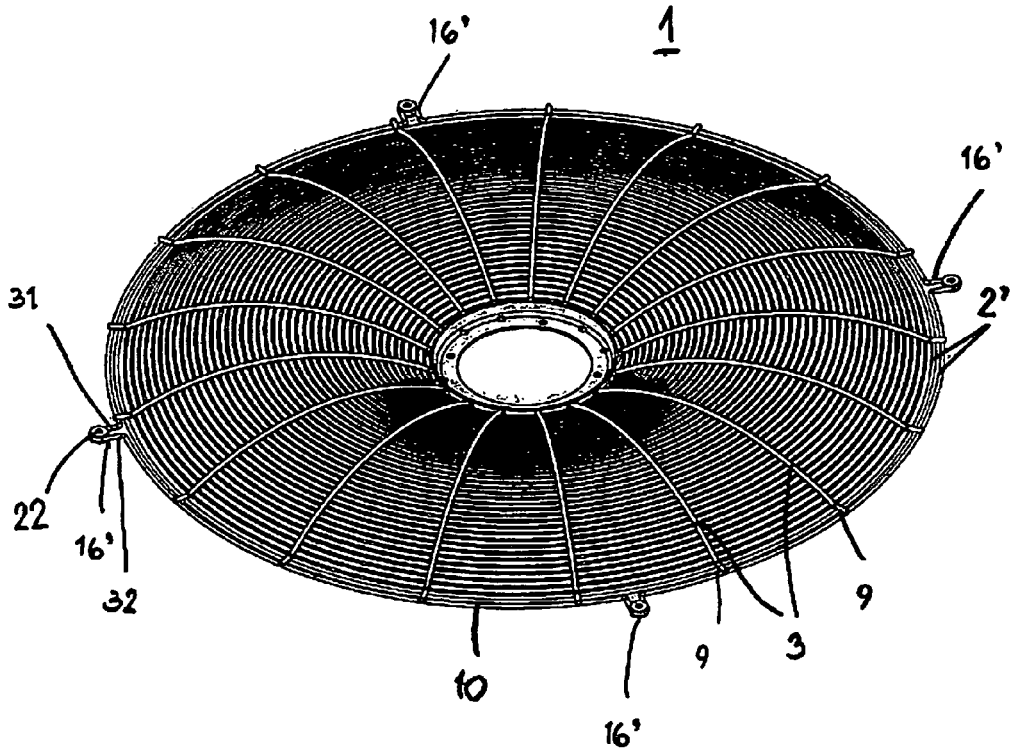
Figure 8:
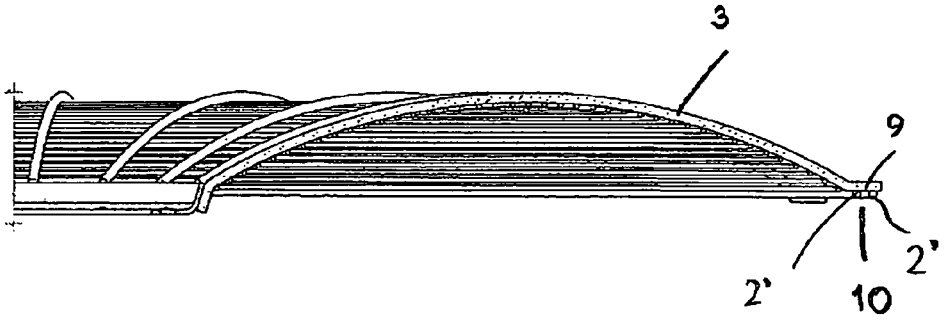
FIG. 8 in enlarged illustration an axial section of the motor suspension according to FIG. 7, FIG. 9 in perspective illustration a fourth embodiment of a motor suspension according to the invention, FIG. 10 in enlarged illustration an axial section of the motor suspension according to FIG. 9, FIG. 11 in perspective illustration a fifth embodiment of a motor suspension according to the invention, FIG. 12 in enlarged illustration an axial section of the motor suspension according to FIG. 11, FIG. 13 in perspective illustration a sixth embodiment of a motor suspension according to the invention, FIG. 14 a bottom view of the motor suspension according to FIG. 13, FIG. 15 in enlarged illustration an axial section of the motor suspension according to FIG. 13, FIG. 16 in perspective illustration the motor suspension according to FIG. 13 which is fastened to a wall ring, FIG. 17 in axial section a device for welding an air grille of the motor suspension according to the invention, FIG. 18 in an illustration according to FIG. 17 a known device for welding an air grille according to the prior art, FIG. 19 in a diagram the efficiency of a motor with the motor suspension according to the invention as a function of the rotary speed of the fan.

In the embodiment according to FIGS. 7 and 8 the outer support ring 10 is formed in an exemplary fashion by two coaxial grille rings 2' which lie side by side at a distance and on which are fastened the angled ends 9 of the braces 3. In contrast to the previous embodiments, the brace ends 9 extend approximately horizontally, viewed in the illustration according to FIG. 8. The brace ends 9 are advantageously welded to the grille rings 2'. Depending on the length of the brace ends 9, the outer support ring 10 may be comprised of only one or more than two grille rings 2'.

In order for the air grille 1 to be fastened, for example, to a wall ring 14 (FIG. 6), the outer grille ring 2' has evenly distributed about its circumference connectors 16' which are formed by radial outwardly deformed parts of the grille ring 2'. The outer grille ring 2' is shaped outwardly in such a way that the connector 16' has two parallel wire segments 31, 32 that extend approximately radially in outward direction and pass in an arch shape into each other as well as in an arch shape into the grille ring 2'. Between the wire segments 31, 32 discs 22 are fastened through which the fastening screws 15 (FIG. 6) project with which the air grille 1 is fastened to the wall ring 14.

For the rest, the air grille according to the FIGS. 7 and 8 is embodied in the same way as the previous embodiments.

The described embodiment according to FIGS. 7 and 8 demonstrates that the outer support ring 10 must not necessarily be formed from a flat material but that also grille rings 2' can be used for connecting the outer brace ends 9.

Figure 9:
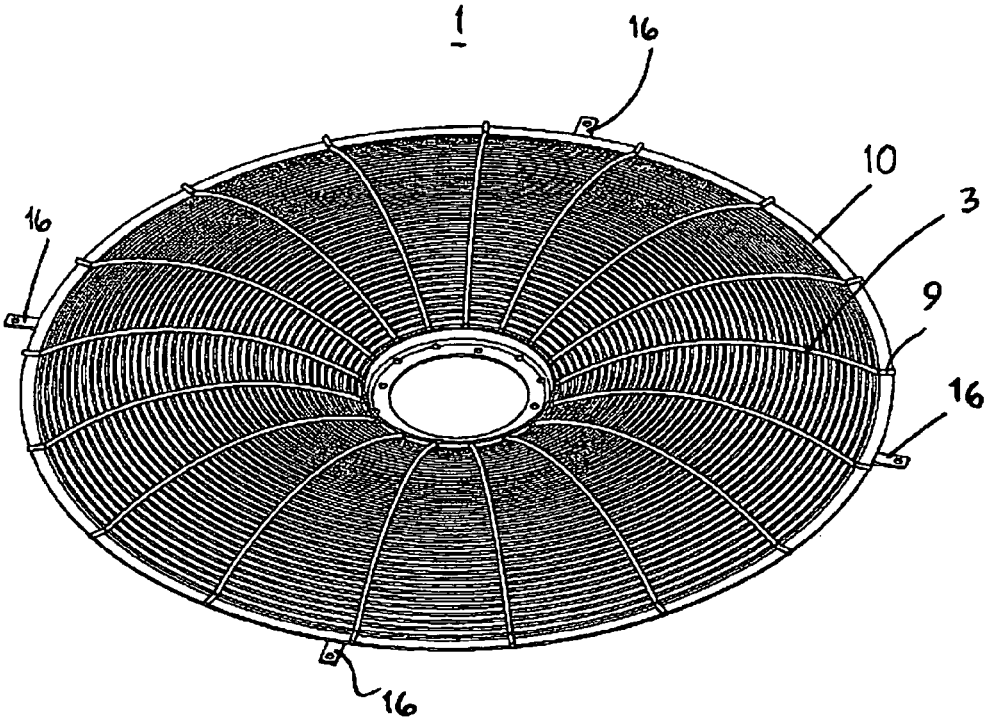
Figure 10:
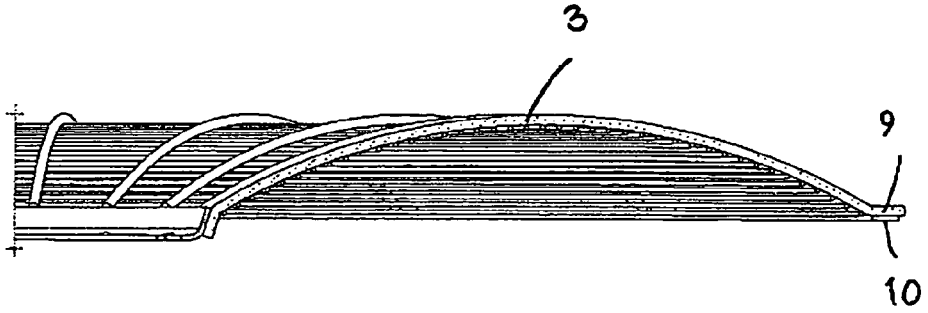

With the embodiment according to FIGS. 9 and 10, the outer support ring 10 is again comprised of a flat material that, however, in contrast to the embodiments of FIGS. 1 to 6, is not upright but horizontally arranged. On the top of the outer support ring 10 the angled ends 9 of the braces 3 are fastened. At the underside of the outer support ring 10, distributed about the circumference, the tabs 16 are fastened which project in radial direction outwardly past the outer support ring 10 and by means of which the air grille 1 is attached in the described manner to the wall ring 14. The brace ends 9 project slightly in radial direction outwardly past the outer support ring 10 on which they are fastened in the described manner across their length. The length of the brace ends 9 can be of course of the same size or less than the radial width of the outer support ring 10.

For the rest, the air grille is embodied in the same way as the previous embodiments.

The air grille 1 according to FIGS. 11 and 12 has again the upright outer support ring 10 that, however, in contrast to the embodiments according to FIGS. 1 to 6, is not made from flat material but from grille rings 2' arranged above one another. In the shown embodiment, the outer support ring 10 is formed by four grille rings 2' positioned on top of each other at a spacing and provided with the same outer diameter, on its outer side the ends 9 of the braces 3 are fastened. Depending on the embodiment, the outer support ring 10 can be comprised of fewer or more grille rings 2'.

Figure 11:
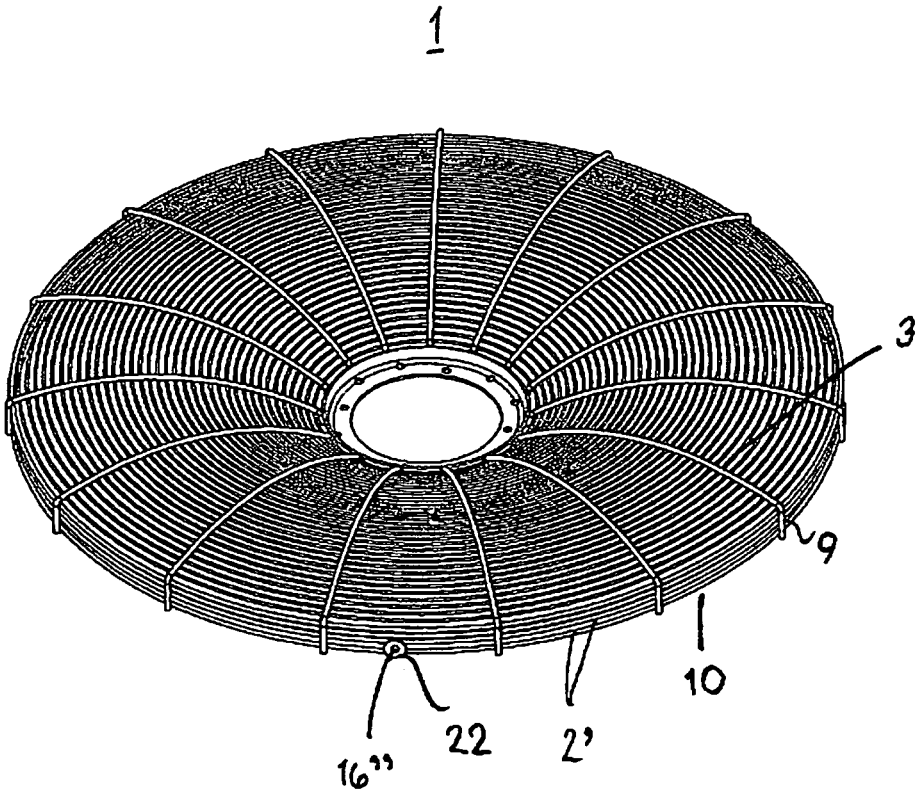

About the circumference of this outer support ring 10 uniformly distributed connectors 16" are provided of which in FIG. 11 only one connector is visible. The connectors 16" are formed in each case by discs 22 which extend with a projection between two neighboring grille rings 2' and are secured between them. Through the discs 22 the fastening screws project with which the air grille 1 is fastened to the fan. The fastening screws extend, as in the embodiment according to FIGS. 1 to 4, in radial direction relative to the air grille 1.

Figure 12:
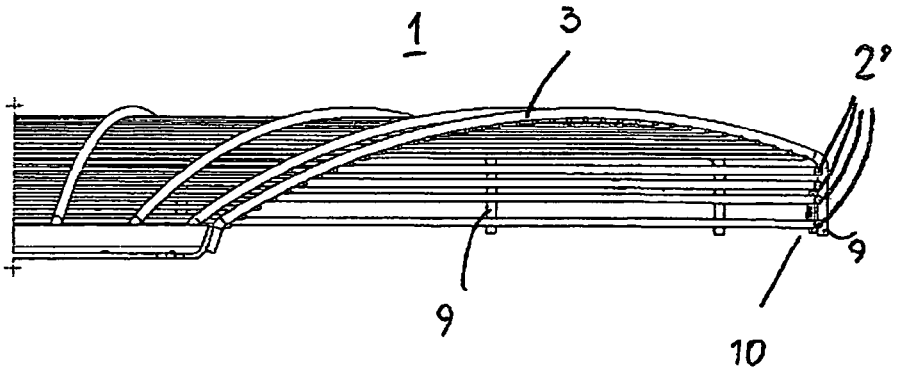

For the rest, the air grille according to FIGS. 11 and 12 is embodied in the same way as the embodiments according to FIGS. 1 to 6.

The air grille concept having been explained with the aid of the embodiments according to FIGS. 1 to 12 enables in use an optimal noise optimization by the fact that the number of the braces 3 can be designed variably and/or in asymmetrical distribution. The braces 3 can be provided therefore optimally in such a way on the air grille 1 that the noise development of the fan, equipped with the air grille, is minimal during use. Thus, the vibrational values can be reached by change of the number of braces and/or by a suitable arrangement on the air grille in an easy manner. Detuning can also be optimally adjusted by a suitable adaptation of the cross-section of the braces and/or together with the number of the braces. Tests have shown that already by means of a cross-sectional change of the fastening braces 17 the vibrational values can be changed significantly. When in this context additionally the variation of the number of the fastening braces 17 is utilized, the vibrational values can be adapted very well to the respective application. In addition, this tuning of the vibrational values can be realized in an inexpensive way. Also, the weight of the air grille 1 is not increased by this measure.

Figure 13:
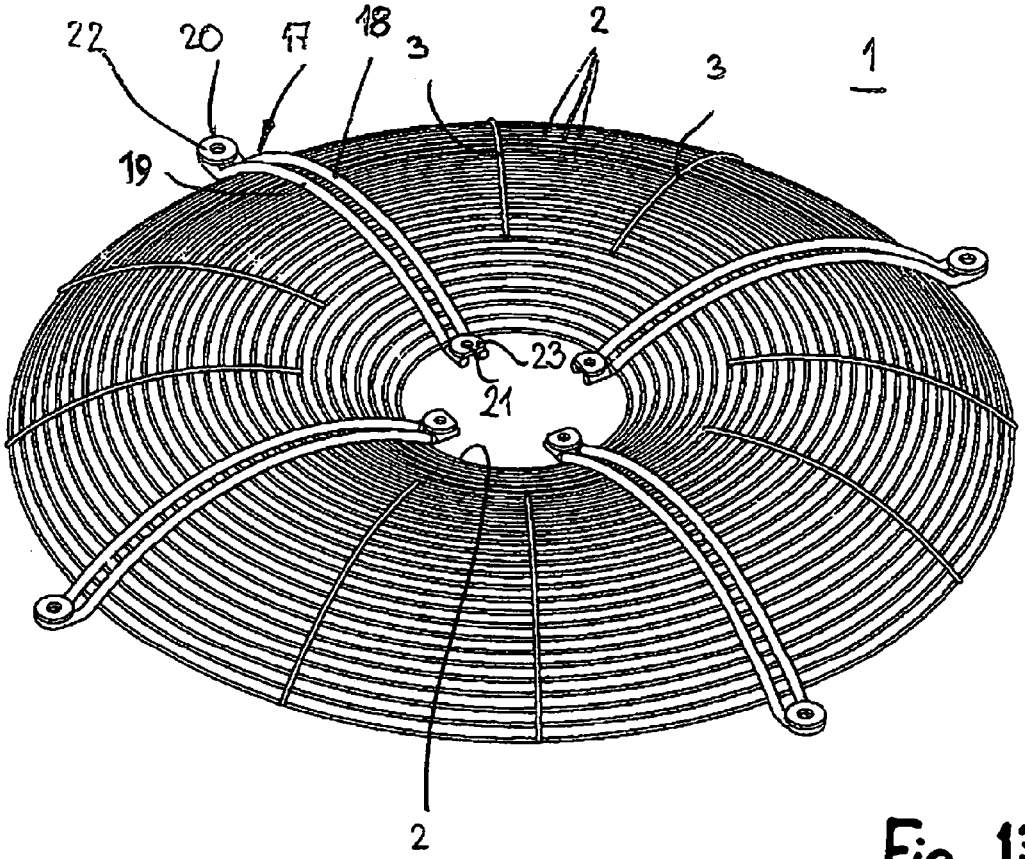
Figure 14:
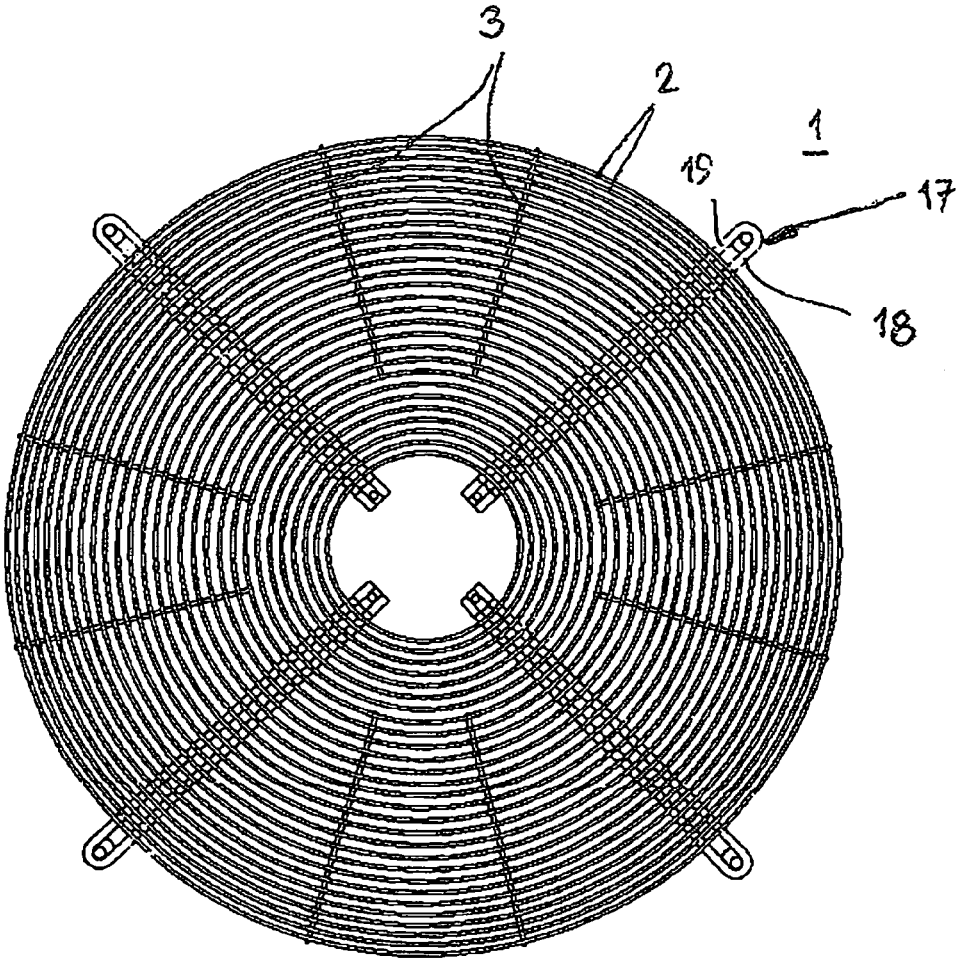
Figure 16:
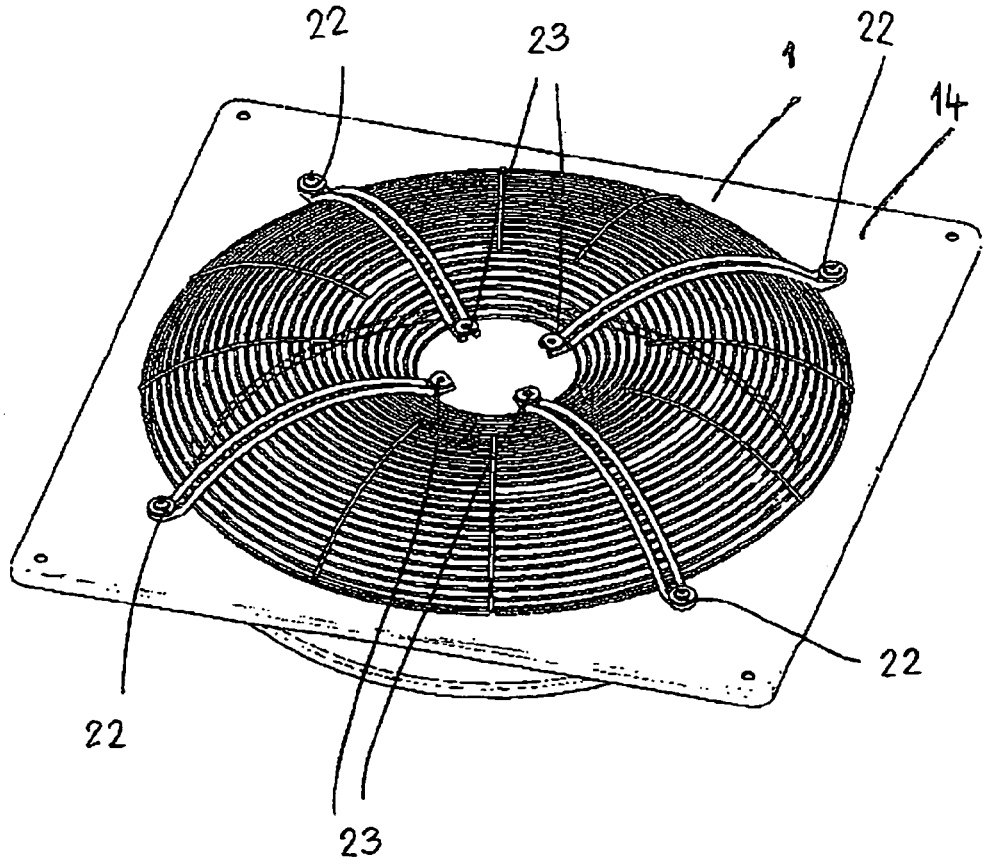

In the motor suspension according to FIG. 13, an inner support ring and an outer support ring are not provided. The motor suspension comprises the grille rings 2 and the radially extending braces 3. They are again arched convexly across their length and extend away from the radial outermost grille ring 2. In contrast to the previous embodiments, the braces 3 do not extend across the whole radial width of the air grille 1 but end at a spacing from the radial inner grille ring 2. For attachment of the air grille 1 on the wall ring 14 (FIG. 16) as well as on the fan (not shown), fastening braces 17 are provided which are curved across their length convexly and are attached, like the braces 3, on the side of the grille rings 2 facing away from the fan. The ends of the fastening braces 17 project past the outer and inner grille rings 2 in radial direction. The fastening braces 17 are provided, as in the previous embodiments, in an exemplary fashion at angular distances of 90° on the air grille 1.

Advantageously, the fastening braces 17 are formed by a hairpin-shaped grille rod whose two legs 18, 19 extend parallel to each other and pass at the radial outer end of the fastening brace 17 in an arch shape into each other.

The ends 20 21 of the fastening braces 17 that are positioned inwardly and outwardly in radial direction are angled such that the air grille 1 can be attached to the wall ring 14 or the fan in a suitable manner. On the ends 20, 21 a disc 22, 23 is fastened, respectively, through which the fastening screws 15 project with which the air grille 1 is to be fastened to the wall ring 14 or to the fan.

Figure 15:
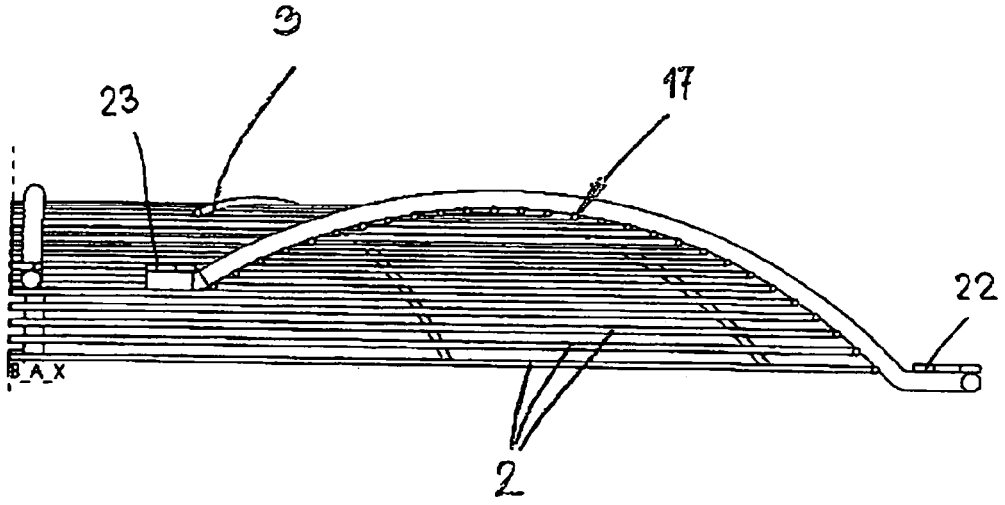

The fastening discs 22, 23 at both ends of the fastening braces 17 are positioned respectively at the same level. As shown in FIG. 15, the discs 23 are however arranged at the radial inner end of the fastening braces 17 axially displaced relative to the discs 22 at the radial outer end of the fastening braces. By means of the discs 22 the air grille 1 is attached to the wall ring 14. The radial inner discs 23 have a spacing to the wall ring 14.

Figure 17:
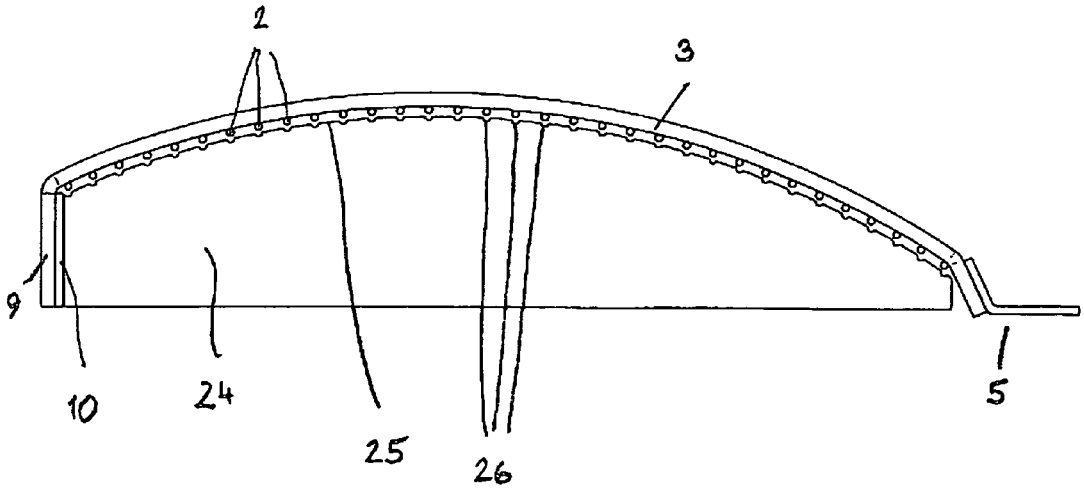

On account of the arched embodiment, the air grille 1 can be welded with a welding device in a single operation. The device for welding comprises an outer ring to which are connected upright radially extending braces. FIG. 17 shows only one of these supports 24. It has a concavely curved end face 25 in which depression 26 are provided that are positioned at a minimal distance to each other one after another. They have only a minimal distance to each other. The supports of the device are so arranged that their depressions are arranged on a circle, respectively. The grille rings 2 of the air grille 1 to be produced are inserted into the depressions 26 of the supports 24. In the embodiment, in every depression 26 a grille ring 2 is positioned. Depending on the embodiment of the air grille 1, the grille rings 2 can be inserted, for example, only in every other depression 26 or also at irregular spacings. Then, with the aid of the upright supports 24, the braces 3, 17 of the air grille 1 can be welded to the grille ring 2. Because the supports 24 are arranged evenly distributed about the circumference of the device and have relatively minimal spacing to each other, the braces 3 can be connected with respect to the desired vibration behavior in the required position and/or number with the grille rings 2, respectively.

With the described device the air grille 1 can be welded in a tub position in one operation because the arch-shaped design of the air grille 1 does not require to employ for each region of the air grille an individual welding device and individual welding process. The air grille therefore can be produced very simply and inexpensively.

Figure 18:
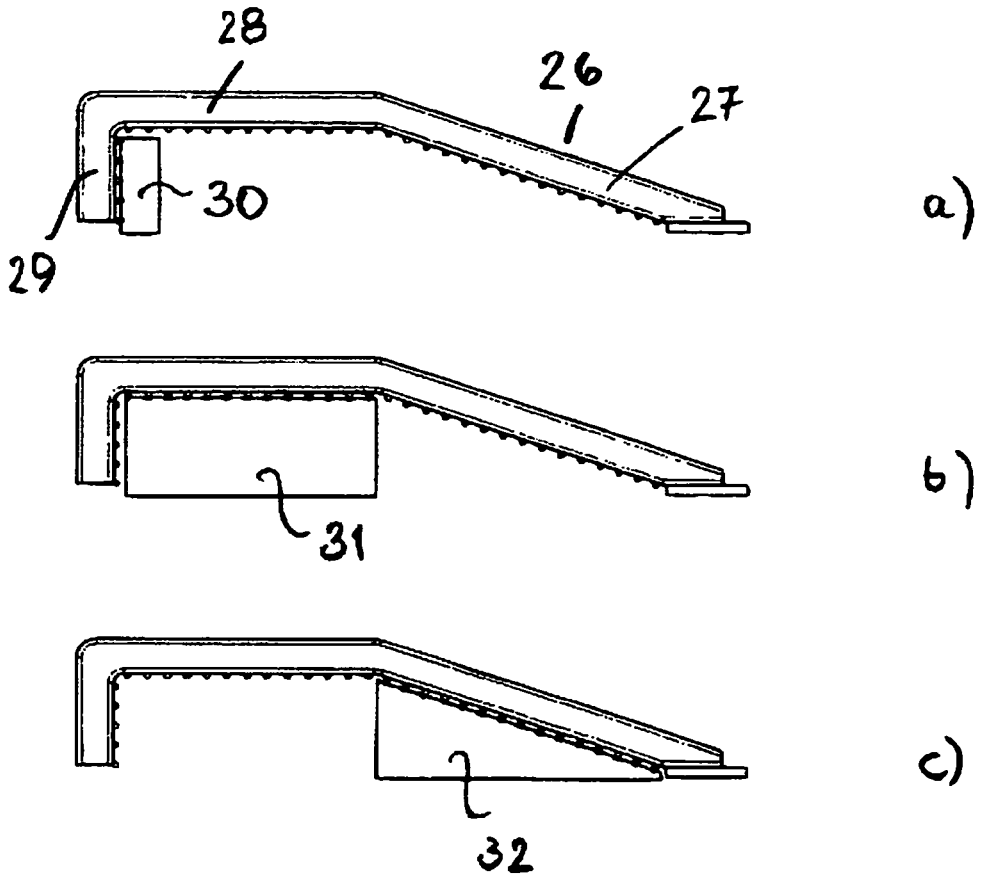

FIG. 18 shows a conventional device for welding the air grille according to the prior art. This air grille 26 has in axial section a straight inner area 27 which adjoins at an obtuse angle a straight middle area 28. A radial outer area 29 adjoins the latter at a right angle. In order to produce such an air grille, three working steps are necessary that are illustrated in the illustrations a) to c) of FIG. 18. All three grille areas 27 to 29 require an individual device 30 to 32 matched to these grille areas, respectively. The production of this air grille 26 is therefore very complex and time-consuming.

The described arched form of the air grille 1 of the described embodiments enables in contrast thereto a very simple and inexpensive production. On account of the arch-shaped curved cross-sectional design of the air grille 1, the latter can be produced in one operation. It is only required that the grille rings 2 required for the air grille 1 must be inserted into the appropriate depressions 26 of the supports 24 and afterwards the required braces 3, 17 must be welded to the inserted grille rings 2.

What it is claimed is:

1. A motor suspension for fans, the motor suspension comprising:

a carrier configured to carry a fan that comprises a motor and a fan wheel, wherein the carrier is an air grille with radially extending braces and individual grille rings that are positioned coaxially to each other relative to a center axis of the air grille and are connected to each other by the radially extending braces;

a monolithic inner support ring comprised of a flat annular part positioned in a radial plane of the air grille and further comprised of an annular upright rim connected to an outer radial circumference of the flat annular part, wherein the braces each have a radial inner end that is fastened to the annular upright rim;

an outer support ring having a center axis coinciding with the center axis of the air grille, wherein the braces each have an angled radial outer end that is fastened to the outer support ring;

wherein the inner support ring further comprises an interface configured to directly connect the fan and wherein the interface is arranged radially inwardly of the annular upright rim on the inner support ring, wherein the air grille alone carries the fan when the fan is directly connected to the interface on the inner support ring and wherein the air grille alone connects and supports the fan on a customer interface in that the outer support ring is connected to a free edge of a nozzle of the customer interface;

wherein, for adapting the motor suspension to a vibration behavior of the fan, at least one of a feature selected from a number of the braces and a diameter of the braces is varied to effect a reduction of acoustic noises and/or natural resonances of the motor suspension.

2. The motor suspension according to claim 1, wherein the number of the braces is unequal to the number of vanes of the fan.

3. The motor suspension according to claim 1, wherein, with the outer support ring, the motor suspension can be embodied individually and independent of connection intervals of the customer interface.

4. The motor suspension according to claim 1, wherein, with the inner support ring, the motor suspension can be embodied individually and independent of connection intervals of the fan.

5. The motor suspension according to claim 2, wherein the braces are comprised of metal.

6. A motor suspension for fans, the motor suspension comprising:

a carrier configured to carry a fan that comprises a motor and a fan wheel, wherein the carrier is an air grille with radially extending braces and individual grille rings that are positioned coaxially to each other and are connected to each other by the radially extending braces;

a monolithic inner support ring comprised of a flat annular part positioned in a radial plane of the air grille and further comprised of an annular upright rim connected to an outer radial circumference of the flat annular part, wherein the braces each have a radial inner end that is fastened to the annular upright rim;

an outer support ring, wherein the braces each have a radial outer end that is fastened to the outer support ring;

wherein the inner support ring further comprises an interface configured to directly connect to the fan and wherein the interface is arranged radially inwardly of the annular upright rim on the inner support ring, wherein the air grille alone carries the fan when the fan is directly connected to the interface on the inner support ring and wherein the air grille alone connects and supports the fan on a customer interface in that the outer support ring is connected to a free edge of a nozzle of the customer interface;

wherein the air grille in axial section has an arched form.

7. The motor suspension according to claim 6, wherein the braces have a radial length and are arched convexly across the radial length.

8. The motor suspension according to claim 7, wherein the braces are comprised of metal.

9. A motor suspension for fans, the motor suspension comprising:

a carrier configured to carry a fan that comprises a motor and a fan wheel, wherein the carrier is an air grille with radially extending braces and individual grille rings that are positioned coaxially to each other relative to a center axis of the air grille and are connected to each other by the radially extending braces;

a monolithic inner support ring comprised of a flat annular part positioned in a radial plane of the air grille and further comprised of an annular upright rim connected to a radial outer circumference of the flat annular part, wherein the braces each have a radial inner end that is fastened to the annular upright rim;

an outer support ring, wherein the braces each have a radial outer end that is fastened to the outer support ring;

wherein the inner support ring further comprises an interface configured to directly connect the fan and wherein the interface is arranged radially inwardly of the annular upright rim on the inner support ring, wherein the air grille alone carries the fan when the fan is directly connected to the interface on the inner support ring and wherein the air grille alone connects and supports the fan on a customer interface in that the outer support ring is connected to a free edge of a nozzle of the customer interface;

wherein, for adapting the motor suspension to a vibration behavior of the fan, at least one of a feature selected from a number of the braces and a diameter of the braces is varied to effect a reduction of acoustic noises and/or natural resonances of the motor suspension.

10. The motor suspension according to claim 9, wherein the radial outer ends of the braces do not project past the outer support ring.

11. The motor suspension according to claim 9, wherein some of the braces have projecting ends that project in radial direction inwardly or outwardly past the grille rings.

12. The motor suspension according to claim 11, wherein the projecting ends are provided with connectors.

13. The motor suspension according to claim 9, wherein the braces include short braces and long braces longer than the short braces, wherein the short braces have a length which is smaller than a radius of the air grille.

14. The motor suspension according to claim 13, wherein the short braces have a smaller cross-section than the long braces.

15. A motor suspension for fans, the motor suspension comprising:

a carrier configured to carry a fan that comprises a motor and a fan wheel, wherein the carrier is an air grille with radially extending braces and individual grille rings that are positioned coaxially to each other relative to a center axis of the air grille and are connected to each other by the radially extending braces;

a monolithic inner support ring comprised of a flat annular part positioned in a radial plane of the air grille and further comprised of an annular upright rim connected to an outer radial circumference of the flat annular part, wherein the braces each have a radial inner end that is fastened to the annular upright rim;

an outer support ring having a center axis coinciding with the center axis of the air grille, wherein the braces each have an angled radial outer end that is fastened to the outer support ring;

wherein the inner support ring further comprises an interface configured to directly connect the fan and wherein the interface is arranged radially inwardly of the annular upright rim;

wherein, for adapting the motor suspension to a vibration behavior of the fan, at least one of a feature selected from a number of the braces and a diameter of the braces is varied to effect a reduction of acoustic noises and/or natural resonances of the motor suspension;

wherein the outer support ring is comprised of a flat material that is bent to a cylinder, wherein the cylinder comprises a cylindrical outer side, and wherein the angled radial outer ends of the braces are fastened to the cylindrical outer side of the cylinder of the outer support ring;

wherein the air grille alone carries the fan when the fan is directly connected to the interface on the inner support ring and wherein the air grille alone connects and supports the fan on a customer interface in that the outer support ring is connected to a free edge of a nozzle of the customer interface.

* * * * *